US009275822B2

(12) United States Patent
Coon et al.

(10) Patent No.: US 9,275,822 B2
(45) **Date of Patent: *Mar. 1, 2016**

(54) LIQUID METAL CONTAINMENT IN AN X-RAY TUBE

(71) Applicant: VARIAN MEDICAL SYSTEMS, INC., Palo Alto, CA (US)

(72) Inventors: Ward Vincent Coon, Salt Lake City, UT (US); Dennis H. Runnoe, Salt Lake City, UT (US); Lawrence Wheatley Bawden, Kearns, UT (US)

(73) Assignee: VARIAN MEDICAL SYSTEMS, INC., Palo Alto, CA (US)

( * ) Notice: Subject to any disclaimer, the term of this patent is extended or adjusted under 35 U.S.C. 154(b) by 236 days.

This patent is subject to a terminal disclaimer.

(21) Appl. No.: 13/663,287

(22) Filed: Oct. 29, 2012

(65) Prior Publication Data

US 2013/0051533 A1 Feb. 28, 2013

Related U.S. Application Data

(63) Continuation of application No. 12/835,248, filed on Jul. 13, 2010, now Pat. No. 8,300,770.

(51) Int. Cl.
*H01J 35/10* (2006.01)

(52) U.S. Cl.
CPC ..... *H01J 35/106* (2013.01); *H01J 2235/1204* (2013.01); *H01J 2235/1208* (2013.01); *H01J 2235/1279* (2013.01)

(58) Field of Classification Search
CPC ..... H01J 35/106; H01J 2235/1204; H01J 35/101; H01J 2235/1208; H01J 2235/1279; H01J 2235/1066; H01J 35/10; H01J 2235/081; H01J 2235/1053; H01J 2235/106; H01J 35/08; H01J 2235/085; H01J 2235/1006; H01J 2235/1013; H05G 1/04; A61B 2560/0223; A61B 2560/04; A61B 2562/085; A61B 5/0031; A61B 5/14532; A61B 5/14539; A61B 5/14542; A61B 5/14546; A61B 5/14865; A61B 5/1495; A61B 5/412; A61B 5/4839; A61B 5/6848; A61B 5/6849; A61B 5/7275; A61B 5/743
USPC ..... 378/130, 132, 133, 141, 144
See application file for complete search history.

(56) References Cited

U.S. PATENT DOCUMENTS

| | | | | |
|---|---|---|---|---|
| 3,694,685 | A * | 9/1972 | Houston | 378/130 |
| 8,009,806 | B2 * | 8/2011 | Legall | 378/132 |
| 2006/0159228 | A1 * | 7/2006 | Vadari et al. | 378/132 |

FOREIGN PATENT DOCUMENTS

JP 06325706 A * 11/1994

* cited by examiner

*Primary Examiner* — Irakli Kiknadze
(74) *Attorney, Agent, or Firm* — Maschoff Brennan

(57) ABSTRACT

Liquid metal containment in an x-ray tube. In one example embodiment, an x-ray tube anode assembly includes a shaft terminated by a head and an anode connected to an anode hub. The anode hub is at least partially surrounding the head of the shaft. The anode hub is configured to contain a volume of a liquid metal and to rotate around the stationary shaft. The anode hub may also define a catch space within the anode hub that is configured to catch the liquid metal in order to contain the liquid metal within the hub while in a non-rotating state and regardless of the orientation of the x-ray tube anode assembly.

20 Claims, 6 Drawing Sheets

LIQUID METAL CONTAINMENT IN AN X-RAY TUBE

This application is a continuation of U.S. patent application Ser. No. 12/835,248, filed Jul. 13, 2010 and issued as U.S. Pat. No. 8,300,770 on Oct. 30, 2012, titled LIQUID METAL CONTAINMENT IN AN X-RAY TUBE, which is incorporated herein by reference in its entirety.

BACKGROUND

An x-ray tube directs x-rays at an intended subject in order to produce an x-ray image. To produce x-rays, the x-ray tube receives large amounts of electrical energy. However, only a small fraction of the electrical energy transferred to the x-ray tube is converted within an evacuated enclosure of the x-ray tube into x-rays, while the majority of the electrical energy is converted to heat. If excessive heat is produced in the x-ray tube, the temperature may rise above critical values, and various portions of the x-ray tube may be subject to thermally-induced deforming stresses.

For example, the anode assembly of a rotating anode x-ray tube is particularly susceptible to excessive temperature and thermally-induced deforming stresses. In particular, as electrons are directed toward the focal track of the anode, the focal track of the anode becomes heated. This heat tends to conduct from the anode to other components of the anode assembly. As the anode can generally sustain much higher temperatures than other components of the anode assembly, the conduction of this heat can, over time, deteriorate the anode assembly resulting in the failure of the rotating anode.

Past efforts to dissipate the heat generated at the anode have involved the use of a liquid metal as a heat transfer medium to transfer the heat through the anode assembly. While the use of a liquid metal as a transfer medium is beneficial, the containment of the liquid metal in appropriate areas of the anode assembly has proven difficult. In particular, as the liquid metal is generally used to transfer heat in a space between a rotating portion of an anode assembly to a stationary portion of the anode assembly, it can be difficult to prevent the liquid metal from draining or splashing out from between the appropriate rotating and stationary portions of the anode assembly. If the liquid metal does escape the appropriate areas of the anode assembly, not only is the heat transfer within the anode assembly degraded, but the liquid metal can also corrode portions of the anode assembly into which the liquid metal has inadvertently drained or splashed.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments relate to liquid metal containment in an x-ray tube. In particular, example anode assemblies disclosed herein include various structures configured to contain liquid metal within the hub regardless of the orientation of the anode assembly. Containment of the liquid metal within the anode hub prevents corrosion by the liquid metal of portions of the anode assembly outside the anode hub and facilitates the dissipation of heat and/or the transfer of electrical current through the liquid metal. This dissipation of heat decreases thermally-induced deforming stresses in x-ray tube components, which thereby extends the operational life of the x-ray tube.

In one example embodiment, an x-ray tube anode assembly includes a stationary shaft terminated by a head and an anode connected to an anode hub. The anode hub is at least partially surrounding the head of the stationary shaft. The anode hub defines a hub opening through which the stationary shaft extends. The anode hub is configured to contain a volume of a liquid metal and to rotate around the stationary shaft. The anode hub also defines a catch space within the anode hub that is configured to catch the liquid metal in order to contain the liquid metal within the hub regardless of the orientation of the x-ray tube anode assembly.

In another example embodiment, an x-ray tube anode assembly includes a stationary shaft, an anode hub at least partially surrounding the stationary shaft, and a diaphragm connected to the anode hub. The anode hub defines a hub opening through which the shaft extends. The anode hub is configured to contain a volume of a liquid metal and to rotate around the stationary shaft. The diaphragm is configured to seal against the stationary shaft when the anode hub is at rest in order to impede the liquid metal from escaping through the hub opening regardless of the orientation of the x-ray tube anode assembly.

In yet another example embodiment, a rotating anode x-ray tube includes an evacuated enclosure, a cathode at least partially positioned within the evacuated enclosure, and an anode assembly at least partially positioned within the evacuated enclosure. The anode assembly includes a volume of liquid metal, a stationary shaft terminated by a head, and an anode connected to an anode hub. The anode hub at least partially surrounds the head and contains the volume of liquid metal. The anode hub defines a hub opening through which the stationary shaft extends. The anode hub is configured to rotate around the stationary shaft. The anode hub also defines a catch space within the anode hub that is configured to catch the liquid metal in order to impede the liquid metal from escaping through the hub opening regardless of the orientation of the x-ray tube anode assembly.

These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments thereof which are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to liquid metal containment in an x-ray tube. In particular, example anode assemblies disclosed herein include various structures configured to contain liquid metal within the hub regardless of the orientation of the anode assembly. Containment of the liquid metal within the anode hub prevents corrosion by the liquid metal of portions of the anode assembly outside the anode hub and facilitates the dissipation of heat and/or the transfer of electrical current through the liquid metal. This dissipation of heat decreases thermally-induced deforming stresses in x-ray tube components, which thereby extends the operational life of the x-ray tube.

Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

I. Example X-Ray Tube

Figure 1:
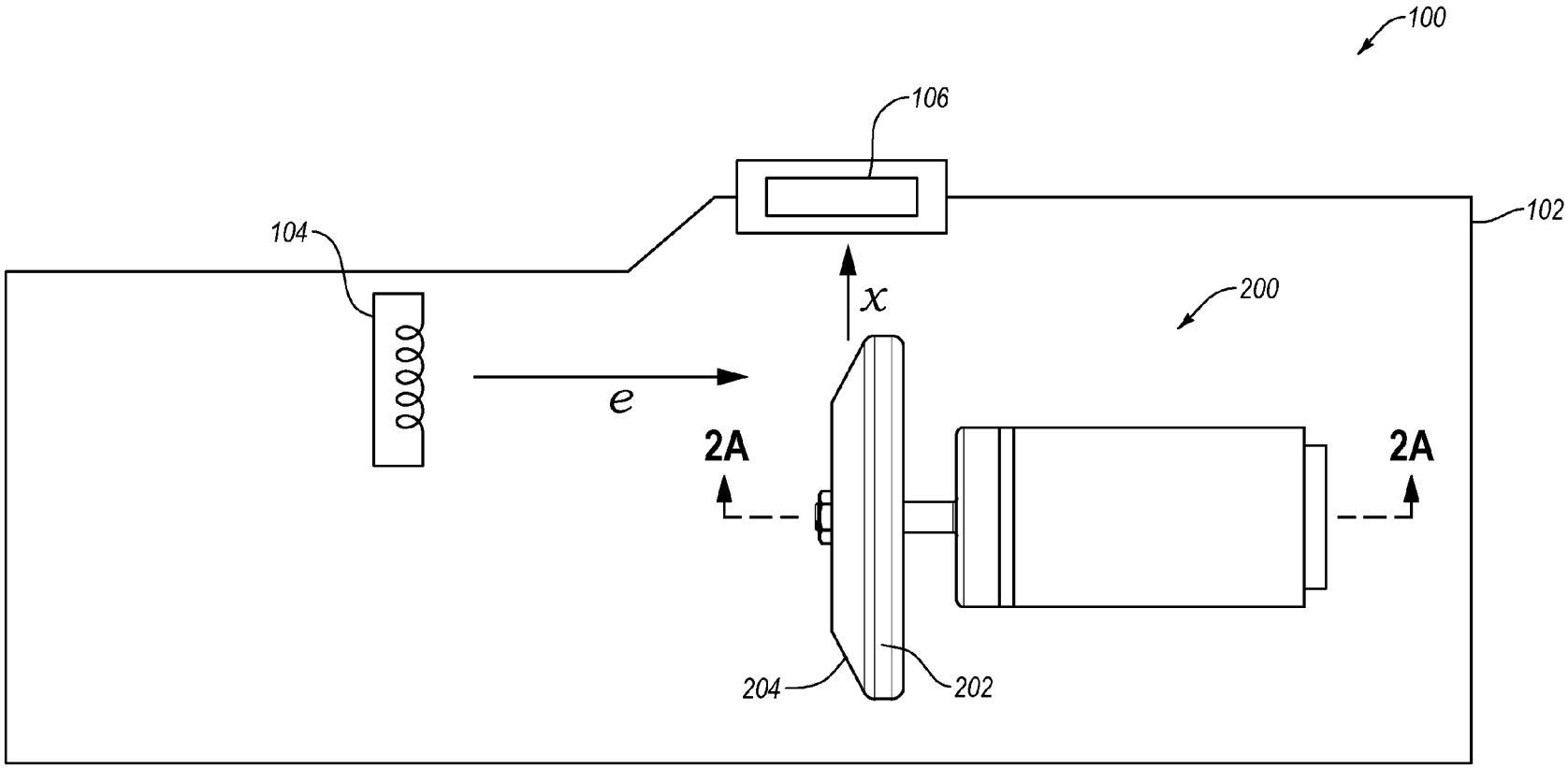
FIG. 1 is a schematic view of an example rotating anode x-ray tube including an example anode assembly.

With reference first to FIG. 1, an example x-ray tube 100 is disclosed. The x-ray tube 100 is a rotating anode type x-ray tube and includes an evacuated enclosure 102 within which a cathode 104 and an anode assembly 200 are positioned. The anode assembly 200 includes an anode 202. The anode 202 is spaced apart from and oppositely disposed to the cathode 104. The anode 202 and cathode 104 are connected in an electrical circuit that allows for the application of a high voltage potential between the anode 202 and the cathode 104. The cathode 104 includes an electron emitter (not shown) that is connected to an appropriate power source (not shown).

As disclosed in FIG. 1, prior to operation of the example x-ray tube 100, the evacuated enclosure 102 is evacuated to create a vacuum. Then, during operation of the example x-ray tube 100, an electrical current is passed through the electron emitter (not shown) of the cathode 104 to cause electrons "e" to be emitted from the cathode 104 by thermionic emission. The application of a high voltage differential between the anode 202 and the cathode 104 then causes the electrons "e" to accelerate from the cathode electron emitter toward a focal track 204 that is positioned on the anode 202. The focal track 204 may be composed for example of tungsten and rhenium or other material(s) having a high atomic ("high Z") number. As the electrons "e" accelerate, they gain a substantial amount of kinetic energy, and upon striking the rotating focal track 204, some of this kinetic energy is converted into x-rays "x".

The focal track 204 is oriented so that emitted x-rays "x" are visible to an x-ray tube window 106. As the x-ray tube window 106 is comprised of an x-ray transmissive material, the x-rays "x" emitted from the focal track 204 pass through the x-ray tube window 106 in order to strike an intended subject (not shown) to produce an x-ray image (not shown). The window 106 therefore seals the vacuum of the evacuated enclosure 102 of the x-ray tube 100 from the atmospheric air pressure outside the x-ray tube 100, and yet enables x-rays "x" generated by the anode 202 to exit the x-ray tube 100.

As the electrons "e" strike the focal track 204, a significant amount of the kinetic energy of the electrons "e" is transferred to the focal track 204 as heat. While the anode 202 can withstand relatively high temperatures, other components of the anode assembly 200, such as the bearings 502 disclosed in FIG. 2A, can only withstand relatively low temperatures. Accordingly, the anode assembly 200 is specifically designed to efficiently dissipate the heat generated at the focal track 204 so that only an acceptably low amount of heat conducts through the anode 202 to the bearings 502, as discussed in greater detail below.

II. Example Anode Assembly

Figure 2A:
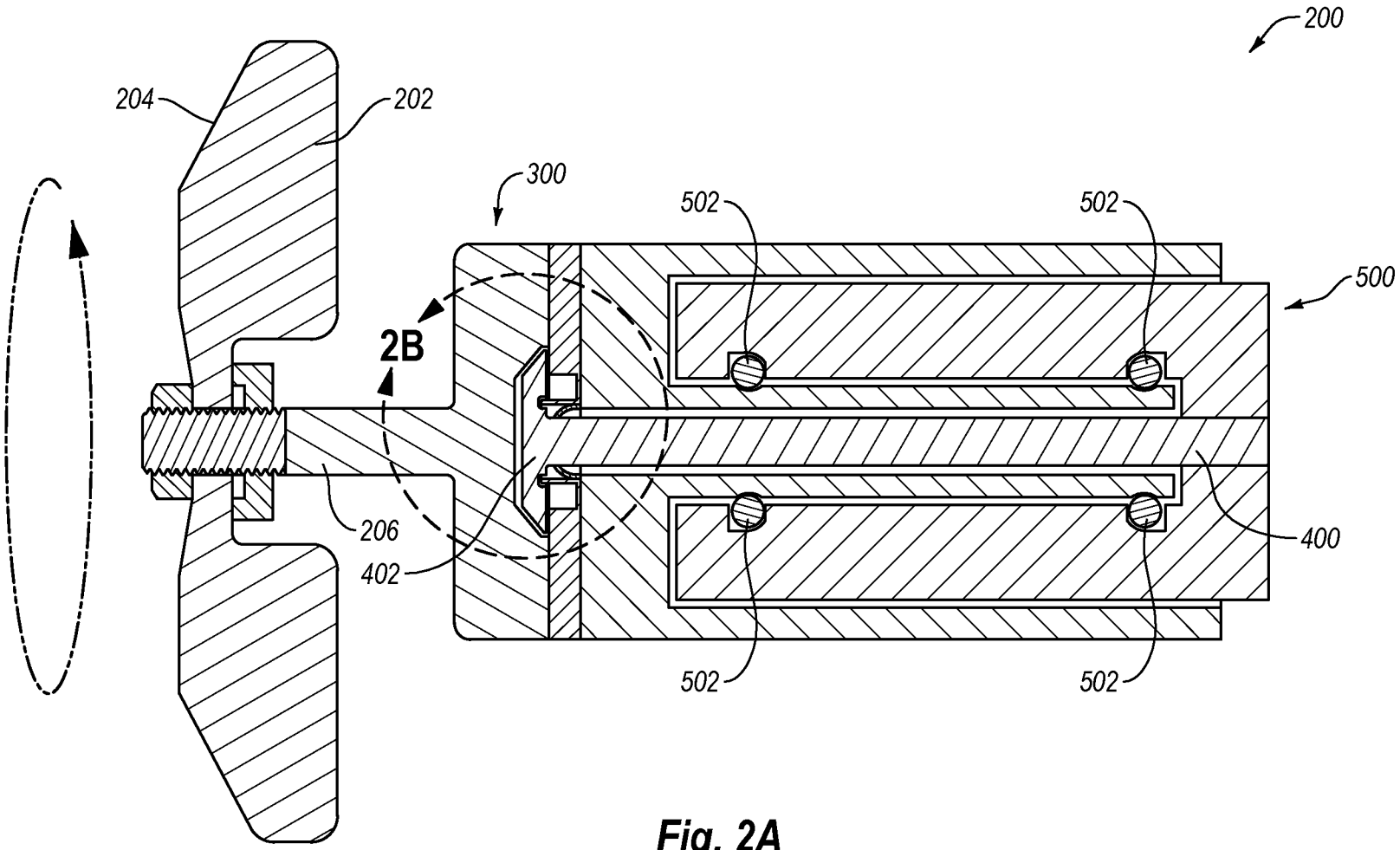
FIG. 2A is a cross-sectional side view of the example anode assembly of FIG. 1.
Figure 2B:
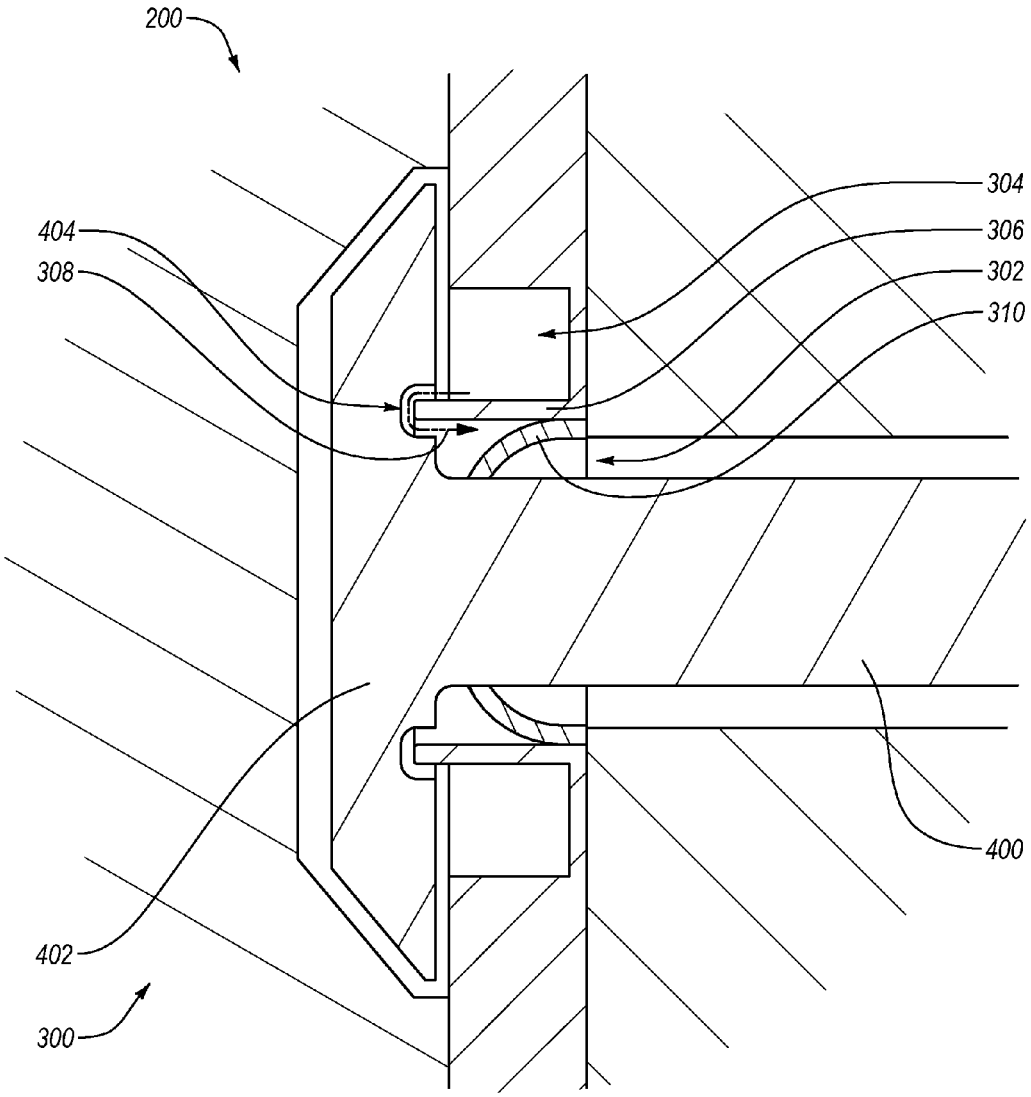
FIG. 2B is an enlarged cross-sectional view of a portion of the anode assembly of FIG. 2A.

With reference to FIGS. 2A and 2B, additional aspects of the example anode assembly 200 are disclosed. As disclosed in FIG. 2A, the example anode assembly 200 generally includes the anode 202, a hub 300, a shaft 206 connecting the anode 202 to the hub 300, a stationary shaft 400, and a bearing assembly 500 including bearings 502. Although the hub 300 is disclosed in FIG. 2A as being connected to the anode 202 via the shaft 206, it is understood that the hub 300 may instead be connected to the anode 202 by being at least partially defined in the anode 202 and/or the shaft 206. The bearings 502 enable a stator (not shown) to cause the rotating anode 202, shaft 206, and hub 300 to rotate about the stationary shaft 400 and bearing assembly 500. It is understood that the ball bearings 502 could be replaced with other types of bearings such as magnetic bearings, air bearings, liquid bearings, or some combination thereof.

As disclosed in FIG. 2A, the stationary shaft 400 is terminated by a head 402. Although the head 402 has a substantially trapezoidal cross section in FIG. 2A, it is understood that the head 402 could instead have a variety of other cross-sectional shapes, such as a substantially rectangular, triangular, or spherical cross section, for example. The hub 300 at least partially surrounds the head 402 of the stationary shaft 400. As disclosed in FIG. 2B, the hub 300 defines a hub opening 302 through which the stationary shaft 400 extends. The gap of the hub opening 302 may have various thicknesses depending, at least in part, on the type of bearing used in the bearing assembly 500.

The hub 300 is configured to contain a volume of a liquid metal (not shown) as the hub 300 rotates around the stationary shaft 400. The liquid metal may be liquid gallium or some combination of liquid gallium and some other liquid metal, such as a liquid gallium indium tin alloy, for example. The liquid metal functions as a heat transfer medium and/or an electrical current transfer medium.

For example, in the embodiment disclosed in the drawings, the liquid metal facilitates the transfer of heat from the anode 202 to the head 402 of the stationary shaft 400 during operation. The heat can then conduct along the stationary shaft 400 away from the anode 202 and thereby exit the anode assembly 200. It is understood that instead of the substantially solid stationary shaft 400 disclosed in the drawings, the stationary shaft 400 could instead use heat pipes or liquid coolants or other heat transfer mediums to remove heat away from the anode 202 and thereby allow the heat to exit the anode assembly 200.

Further, in addition to transferring heat, in at least some alternative embodiments to the embodiment disclosed in the drawings, such as embodiments with ceramic or magnetic bearings, the liquid metal may also serve as an electrical brush or contact for transferring electrical current.

In at least some example embodiments, the hub 300 and the head 402 of the stationary shaft 400 are formed from molybdenum, titanium, and zirconium, since molybdenum is relatively resistant to corrosion by gallium. Such metals may be coated on more thermally conductive metals (such as copper) to render the coated surface corrosion resistant to gallium, while improving the heat transfer capability. Other portions of the anode assembly 200 may be formed from tool steel, which is relatively easily corroded by gallium but is an excellent material for forming various components, such as the races for the bearings 502, for example.

In order for the liquid metal to function properly as a heat transfer medium, and/or as an electrical current transfer medium as discussed above, the liquid metal must be contained within the hub 300 in the space surrounding the head 402. If the liquid metal drains or splashes out of the hub 300 through the hub opening 302, the liquid metal can corrode portions of the anode assembly 200, such as the bearings 502 of the bearing assembly 500 and components formed from tool steel, as well as decrease the transfer of heat from the anode 202 to the head 402 of the stationary shaft 400.

In order to prevent the liquid metal from draining or splashing out of the hub 300 through the hub opening 302, the hub 300 may define a catch space 304 within the hub 300 that is configured to catch the liquid metal in order to contain the liquid metal within the hub 300 regardless of the orientation of the x-ray tube anode assembly 200, as disclosed in FIGS. 2A and 2B. The catch space 304 may be an annular catch space. In at least some example embodiments, the volume of the catch space 304 is greater than or equal to the volume of the liquid metal contained in the hub 300, which enables the catch space 304 to contain substantially all of the liquid metal and prevent the liquid metal from draining or splashing out of the hub 300 through the hub opening 302. The catch space 304 enables the thickness of the gap of the hub opening 302 to be greater than the meniscus of the liquid metal contained in the hub 300, for example.

It is understood that the cross section of the catch space 304 may have various shapes. For example, the walls of the catch space 304 may be configured with specific shapes and geometries to facilitate the movement of the liquid metal from the catch space 304 when stationary to the head 402 of the stationary shaft 400 when rotating or to prevent splashing. The cross section of the catch space 304 may be rectangular (see the catch space 304" of FIG. 2E), trapezoidal, circular or any combination of shapes to facilitate or to prevent the movement of the liquid metal at various speeds of rotation and at various orientations of the anode assembly 200.

For example, instead of a square-shaped cross section, the cross section of the catch space 304 may have a substantially circular shape in order to reduce spilling and splashing of the liquid metal during shipment. Further, as disclosed in the alternative embodiment disclosed in FIG. 2D, a catch space 304' of an alternative hub 300' of a first alternative anode assembly 200' includes a curved inner wall 304*a* and an angled outer wall 304*b*. This angled outer wall 304*b* facilitates draining of the liquid metal when the catch space 304' transitions from being stationary to rotating, while the curved inner wall 304*a* reduces spilling and splashing of the liquid metal during shipment and during operation.

As disclosed in FIG. 2B, the hub 300 may further define an annular flange 306 which extends into an annular slot 404 defined in the stationary shaft 400. The flange 306 and the slot 404 cooperate to define a path 308 that has a substantially u-shaped cross section. The path 308 is configured to further impede the liquid metal from draining or splashing out of the hub 300 through the hub opening 302 regardless of the orientation of the anode assembly 200.

It is understood, however, that the hub 300 and the head 402 of the stationary shaft 400 could instead cooperate to define a path that has a substantially v-shaped or circular-shaped cross section. Further, the path can include two or more of any of the above mentioned cross sections in a series to form a serpentine-shaped or zig-zag-shaped cross section. For example, as disclosed in FIG. 2E, an alternative hub 300" and an alternative head 402" of a second alternative anode assembly 200" cooperate to define a path 308" that includes a cross section of alternating u-shaped sections in a serpentine arrangement. It is understood that the path 308" could instead include a cross section of alternating v-shaped sections in a zig-zag arrangement. The path 308" could also include any combination of the above-mentioned cross sections. For example, the path 308' of FIG. 2D also differs from the path 308 due to the configuration of the catch space 304'.

Figure 2C:
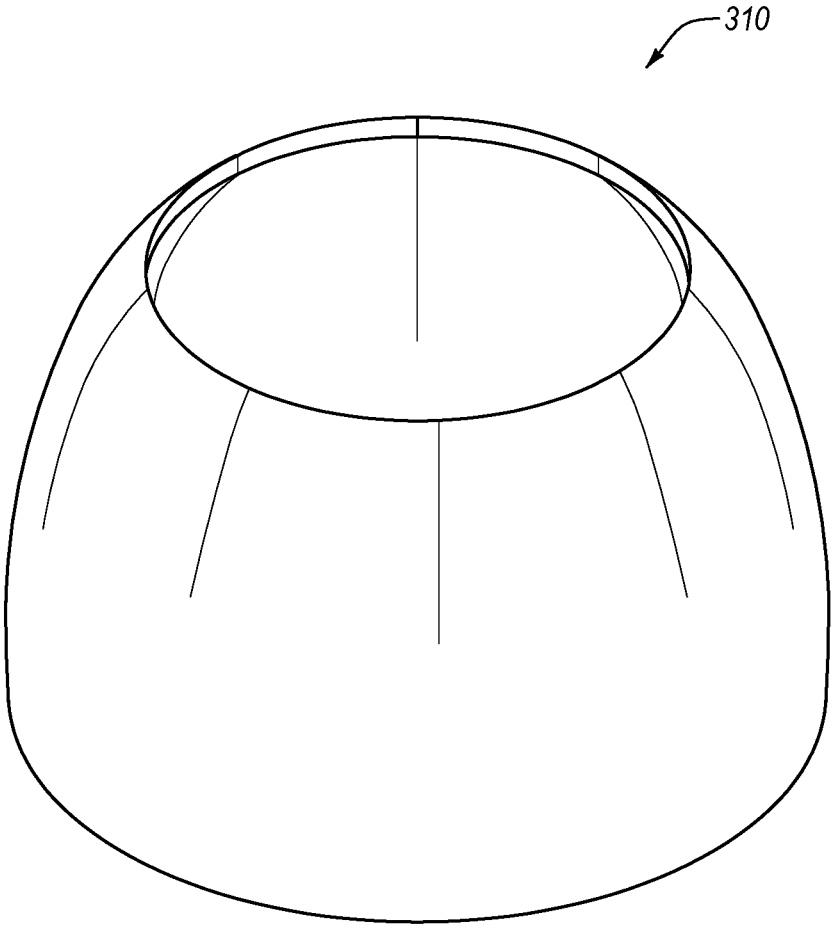
FIG. 2C is a perspective view of an example diaphragm.
Figure 2D:
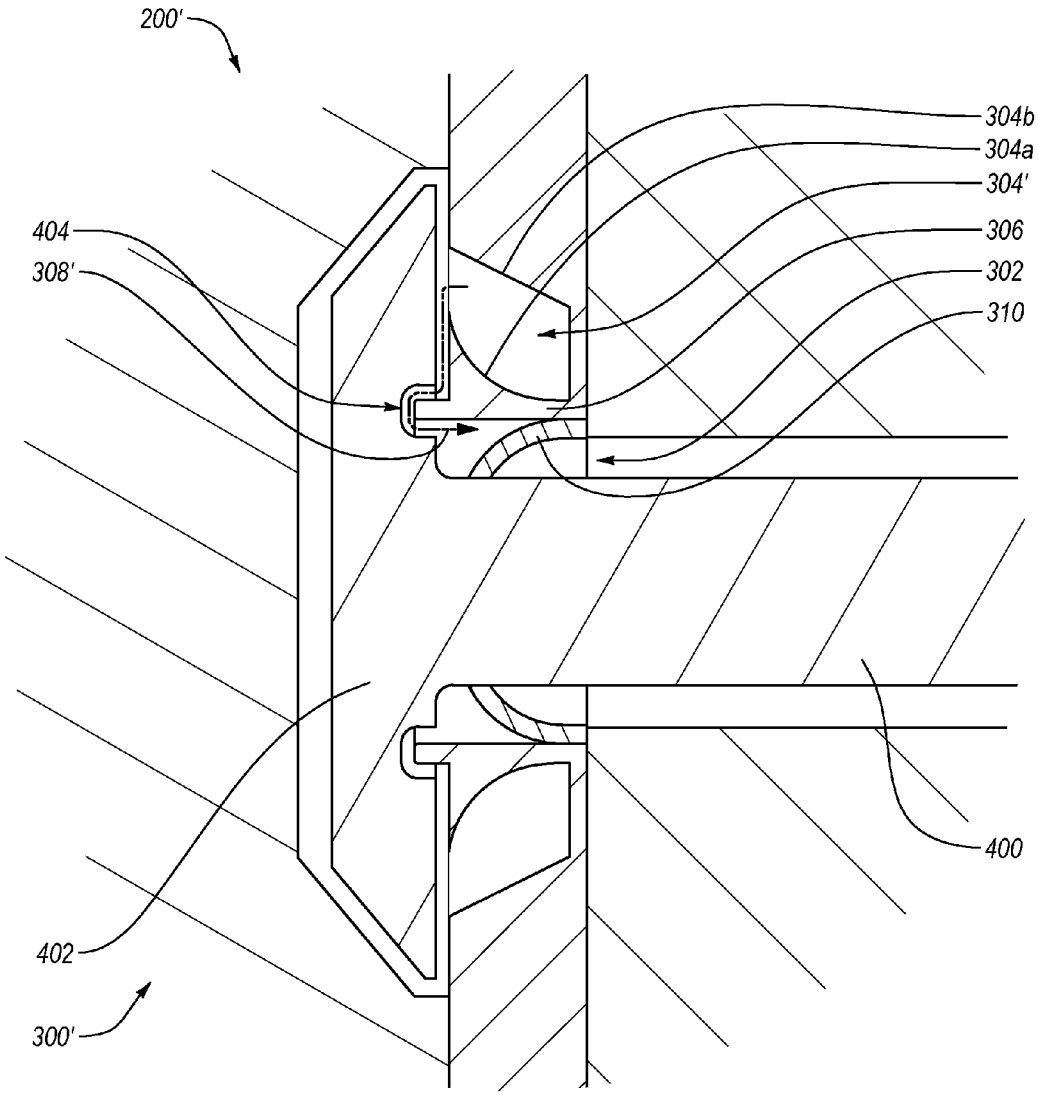
FIG. 2D is an enlarged cross-sectional view of a portion of a first alternative anode assembly.
Figure 2E:
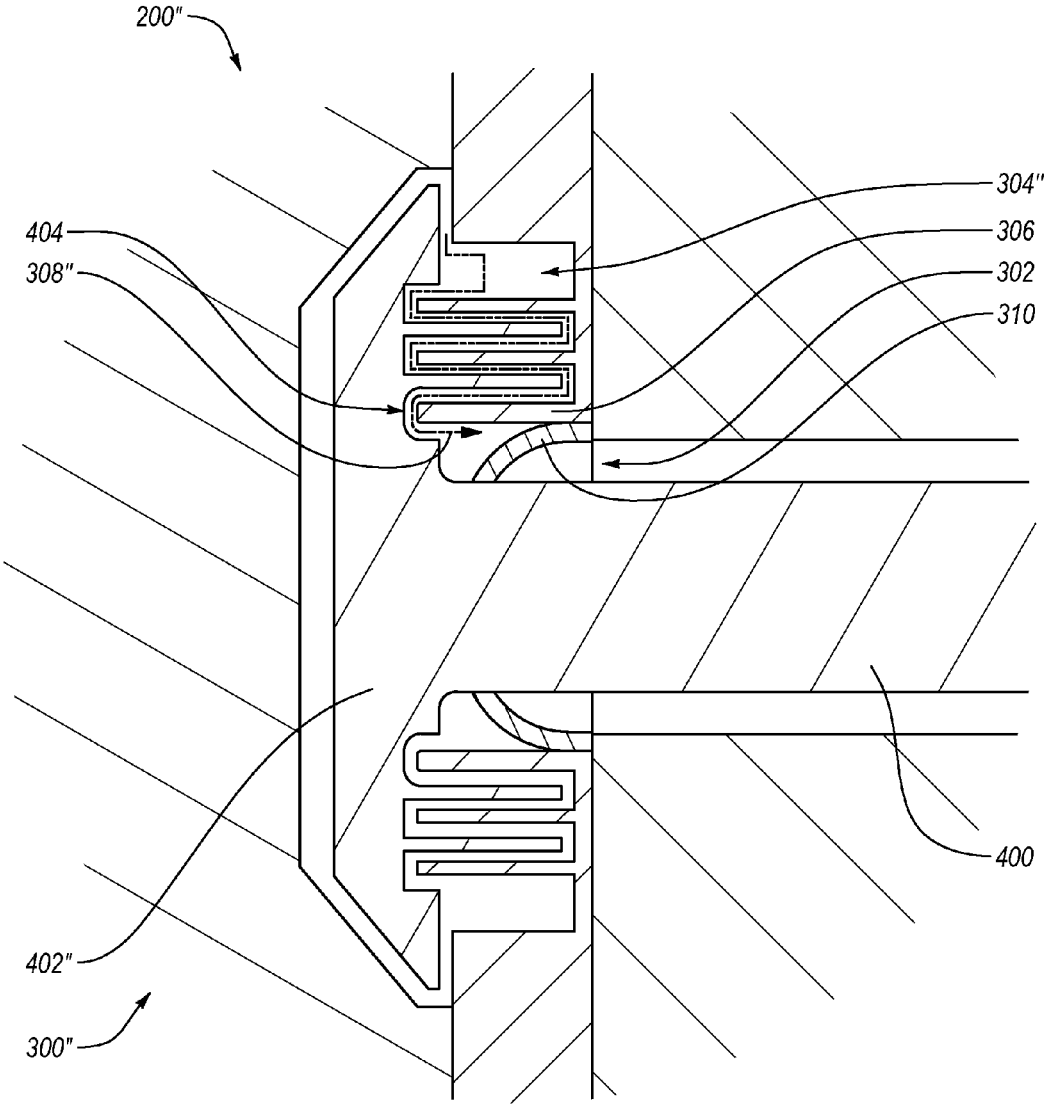
FIG. 2E is an enlarged cross-sectional view of a portion of a second alternative anode assembly.

As disclosed in FIGS. 2B and 2C, in addition to, or in lieu of, the catch space 304 and/or the flange 306 and the slot 404, the anode assembly 200 may include a diaphragm 310 connected to the hub 300. The diaphragm 310 is configured to seal against the stationary shaft 400 when the hub 300 is at rest in order to impede the liquid metal from escaping from the hub 300 through the hub opening 302 regardless of the orientation of the anode assembly 200. During rotation of the hub 300, the diaphragm 310 is further configured to unseal from, and thereby avoid rubbing against and creating friction with, the stationary shaft 400.

For example, as disclosed in FIGS. 2B and 2C, the diaphragm 310 may include leaves surrounding an opening through which the stationary shaft 400 extends. The leaves are configured to seal against the stationary shaft 400 when the hub 300 is at rest (as disclosed in FIGS. 2A and 2B) and to unseal from the stationary shaft 400 when the hub 300 is rotating (not shown). In at least some example embodiments, the leaves may be configured to overlap by sliding over one another and to dilate iris-like when the hub 300 is rotating.

The annular catch spaces 304, 304', and 304", the paths 308, 308', and 308", and/or the diaphragm 310 disclosed herein, either in isolation or in combination, are configured to prevent liquid metal from draining or splashing out of the hub 300 regardless of the orientation of the anode assembly 200 and the x-ray tube 100. The orientation of the x-ray tube 100 may change during operation in order to produce x-rays at various angles with respect to an intended subject. For example, when used in a cardiac operation, the x-ray tube 100 may be mounted on a flexible arm to enable the x-ray tube 100 to be rotated to a variety of orientations with respect to a cardiac patient.

Containment of the liquid metal within the hub 300 prevents corrosion by the liquid metal of portions of the anode assembly 200 outside the hub 300, such as the bearings 502 of the bearing assembly 500, and facilitates the dissipation of heat, and in some embodiments the transfer of electrical current, from the anode 202 to the stationary shaft 400 through the liquid metal. This dissipation of heat decreases thermally-induced deforming stresses in components of the x-ray tube 100, which thereby extends the operational life of the x-ray tube 100.

The example embodiments disclosed herein may be embodied in other specific forms. The example embodiments disclosed herein are therefore to be considered in all respects only as illustrative and not restrictive.

What is claimed is:

1. An x-ray tube anode assembly comprising:

an anode hub defining an opening configured to receive a shaft;

the anode hub configured to retain a volume of a liquid metal when the anode hub rotates around the shaft; and a diaphragm configured to substantially create a liquid metal seal across the anode hub opening when the anode hub is at rest.

2. The x-ray tube anode assembly as recited in claim 1, further comprising means for substantially retaining the liquid metal within the anode hub when the anode hub is at rest in a non-rotating state regardless of the orientation of the x-ray tube anode assembly.

3. The x-ray tube anode assembly as recited in claim 2, wherein the means for retaining comprises a catch space formed in the anode hub.

4. The x-ray tube anode assembly as recited in claim 3, wherein a volume of the catch space is greater than or equal to the volume of the liquid metal.

5. The x-ray tube anode assembly as recited in claim 3, wherein the catch space is an annular catch space.

6. The x-ray tube anode assembly as recited in claim 3, wherein the catch space has a rectangular cross-sectional shape.

7. The x-ray tube anode assembly as recited in claim 3, wherein the catch space includes an angled wall and a curved wall.

8. The x-ray tube anode assembly as recited in claim 2, wherein the means for retaining comprises a liquid metal path defined between the anode hub and a head portion of the shaft.

9. The x-ray tube anode assembly as recited in claim 8, wherein the path is formed to have a substantially u-shaped, v-shaped, or circular-shaped path.

10. The x-ray tube anode assembly as recited in claim 8, wherein the path is at least partially defined via a flange formed on the anode hub that extends into a slot defined in the head portion of the shaft.

11. The x-ray tube anode assembly as recited in claim 2, wherein the means for retaining comprises:

a catch space formed in the anode hub; and a liquid metal path defined between the anode hub and a head portion of the shaft.

12. The x-ray tube anode assembly as recited in claim 1, wherein the diaphragm is further configured to unseal from the shaft when the anode hub is rotating in order to avoid contact with the shaft while the anode hub is rotating.

13. The x-ray tube anode assembly as recited in claim 1, wherein the diaphragm comprises leaves surrounding an opening through which the shaft extends, the leaves configured to seal against the shaft when the anode hub is at rest and to unseal from the shaft when the anode hub is rotating.

14. The x-ray tube anode assembly as recited in claim 1, wherein the shaft is received within the opening along a head portion of the shaft, and the head portion has a substantially trapezoidal, triangular, spherical, or rectangular cross section.

15. The x-ray tube anode assembly as recited in claim 1, wherein the anode hub is at least partially defined by an anode and/or by a rotating shaft connected to the anode.

16. The x-ray tube anode assembly as recited in claim 1, wherein the liquid metal comprises liquid gallium.

17. The x-ray tube anode assembly as recited in claim 1, wherein at least a portion of the shaft comprises molybdenum, titanium, and zirconium.

18. The x-ray tube anode assembly as recited in claim 1, wherein the anode hub comprises molybdenum, titanium, and zirconium.

19. The x-ray tube anode assembly as recited in claim 1, further comprising bearings which enable the anode hub to rotate around the shaft, the bearings comprising ball bearings, magnetic bearings, air bearings, fluid bearings, or some combination thereof.

20. A rotating anode x-ray tube, comprising:

an evacuated enclosure;

a cathode at least partially positioned within the evacuated enclosure; and the x-ray tube anode assembly as recited in claim 1 at least partially positioned within the evacuated enclosure.

* * * * *